US005156110A

United States Patent [19]

Fuller

[11] Patent Number: 5,156,110

[45] Date of Patent: Oct. 20, 1992

[54] CONNECTOR ASSEMBLY AND POINT-OF-PURCHASE ADVERTISING DEVICE

[75] Inventor: Ronald B. Fuller, Runcorn, Australia

[73] Assignee: CVN Pty Ltd., Queensland, Australia

[21] Appl. No.: 756,154

[22] Filed: Sep. 6, 1991

[30] Foreign Application Priority Data

Sep. 10, 1990 [AU] Australia ..... PK2216

[51] Int. Cl.[5] ..... G09F 17/00

[52] U.S. Cl. ..... 116/173; 248/535; 248/912

[58] Field of Search ..... 116/173, 174, 175; 248/515, 514, 912, 911, 225.1, 223.4, 535, 538, 126; 40/606, 607

[56] References Cited

U.S. PATENT DOCUMENTS

| | | | |
|---|---|---|---|
| 904,512 | 11/1908 | Dailey | 116/175 |
| 1,295,274 | 2/1919 | Crichton | 116/174 |
| 1,765,245 | 6/1930 | Scott | 116/173 |
| 2,174,140 | 9/1939 | Schofield | 248/538 X |
| 2,646,240 | 7/1953 | Anderson | 248/514 X |
| 2,794,414 | 6/1957 | Reifschneider | 116/175 |
| 3,023,725 | 3/1962 | Boyd | 116/173 |
| 3,927,315 | 12/1975 | Werry | 248/223.4 X |
| 4,439,940 | 4/1984 | Deryk | 40/607 X |
| 4,593,877 | 6/1986 | van der Wyk | 248/535 X |
| 4,864,962 | 9/1989 | Kuehl et al. | 116/174 |

FOREIGN PATENT DOCUMENTS

| | | | |
|---|---|---|---|
| 0701564 | 1/1965 | Canada | 116/173 |
| 0351379 | 7/1905 | France | 248/538 |
| 8203775 | 4/1984 | Netherlands | 116/173 |
| 0068275 | 9/1944 | Norway | 248/538 |

*Primary Examiner*—William A. Cuchlinski, Jr.
*Assistant Examiner*—John L. Beres
*Attorney, Agent, or Firm*—Helfgott & Karas

[57] ABSTRACT

A reconfigurable connector assembly (10) comprising a bracket (11) and a coupling block (12), the assembly (10) is suitable for a reconfigurable point-of-purchase advertising device which typically includes a flag pole (13). The bracket (11) includes a channel (14) having opposed projections (15, 16) and opposed longitudinally extending recesses (17, 18) generally underlying the projections (15, 16) respectively. The coupling block (12) has opposed side walls (19, 20) each side wall being provided with projection receiving slots (21, 22, 23, 24) for side (19) and (21', 22', 23', 24') for side (20). The projection receiving slots of side wall (19) are a mirror image of the projection receiving slots of side wall (20). The coupling block (12) can be rotated according to arrows (25, 26) so that any pair of slots can be aligned with the projections (15, 16). The coupling block (12) can be oriented at any of four selected angles according to which slots engage with which projections so that a flag pole inserted into through hole (27) can adopt a changed orientation in order to provide variation to improve the impact of a point-of-purchase advertisement.

5 Claims, 2 Drawing Sheets

CONNECTOR ASSEMBLY AND POINT-OF-PURCHASE ADVERTISING DEVICE

This invention relates to a connector assembly and in particular to a reconfigurable connector assembly suitable for a point-of-purchase advertising device.

While the following description will deal with application of the present invention to a "point-of-purchase" advertising device, it will be apparent that the present invention has more general application.

BACKGROUND OF THE INVENTION

It has been customary to advertise at point-of-purchase by using posters, banners and other similar media which can carry advertising logos, prices, and so forth.

For example, U.S. Pat. No. 4,038,767 discloses a flexible flag advertising sign where a stand having a plurality of overlapping flags or banners is employed. The banners can be folded back to display a selected one of the banners. This enables variation of the printed matter displayed but does not allow for a significant alteration in the overall shape and impact of the display.

As another example, U.S. Pat. No. 4,233,769 discloses an upstanding advertising sign which employs a flag suspended from a flag pole, the flag pole being removably located in a pocket on the sign. There is no provision for significant visual variation in the sign or flag apart from changing the actual printed matter on the sign.

The problem with all these advertising devices is that they lack characteristics which enable variation or where there is any variation, it has little impact, particularly in situations where passers-by or potential customers see the same old advertising displays day after day.

It would be desirable to provide a simple flag or banner type advertising display which is readily adapted to simple variation which enables the display to be suited to different situations and also to be changed on a regular basis so that the impact of the advertising carried by the display is less likely to become mundane.

It is an object of the present invention to provide a reconfigurable connector assembly and associated point-of-purchase advertising device which alleviates at least to some degree the aforementioned problems associated with the prior art.

SUMMARY OF THE INVENTION

In one broad aspect therefore, the present invention resides in a reconfigurable point-of-purchase advertising device comprising a bracket securable to a fixture, a coupling block which can be coupled to the bracket in a selected one of a plurality of orientations, and a flag pole which can be coupled to the coupling block so that the orientation of the flag pole is dictated by the orientation of the coupling block.

In a further aspect, the invention resides in a reconfigurable connector assembly suitable for a reconfigurable point-of-purchase advertising device, the connector assembly including a bracket and a coupling block, the bracket having a channel, the channel having opposed projections and opposed longitudinally extending recesses generally underlying said projections, the coupling block having opposite side walls, each side wall being provided with projection receiving slots, the projection receiving slots of one side wall being a mirror image of the projection receiving slots of the other side wall, said block being slidably insertable into said bracket so that said projections can couple with a selected pair of said slots in order to selectively orient the block relative to the bracket.

The point-of-purchase advertising device preferably includes a plurality of interchangeable flags or the like which can be suspended from the flag pole to give a particular flag orientation depending on the orientation of the flag pole. In this regard, it is advantageous that the flag pole have a flag attachment means which facilitates easy attachment and detachment flags. In one preferred embodiment, the flag pole includes a longitudinally extending slit through which a flag can be threaded, the flag having an edge carrying expanded edge sections which do not readily pass through the slit.

The bracket can be of any shape, the channel is preferably open at one end and closed at its opposite end so that the coupling block can be inserted hard up against the closed end of the channel.

The coupling block can be of any shape but is preferably of rectangular prism shape. Alternatively, the block can include one or more oblique faces. The projection receiving slots preferably extend across the respective side walls so that the slots are open at each end making the block reversible. The slots are preferably spaced from the edges of the side wall a distance corresponding to the depth of the recesses in the channel, this therefore affords a tight friction fit between the bracket and the coupling block when the coupling block is in place. The slots can be set at any position to each other but for a typical set up, two slots are located at approximately 90° to each other and a third slot extends as an oblique slot to the other two slots. This enables a flag to be positioned at two orientations, that is at 90° to each other with a third possibility somewhere between the two.

The coupling block when used as a flag coupling block for connecting a flag pole to the bracket includes a flag pole attachment means. One form of flag pole attachment means comprises a socket in which a flag pole can be frictionally received. The socket can be a through hole extending through the block so that the block is reversible.

In order that the invention can be more readily understood and be put into practical effect, reference will now be made to the accompanying drawings and wherein:

DESCRIPTION OF THE PREFERRED EMBODIMENTS

Figure 1:
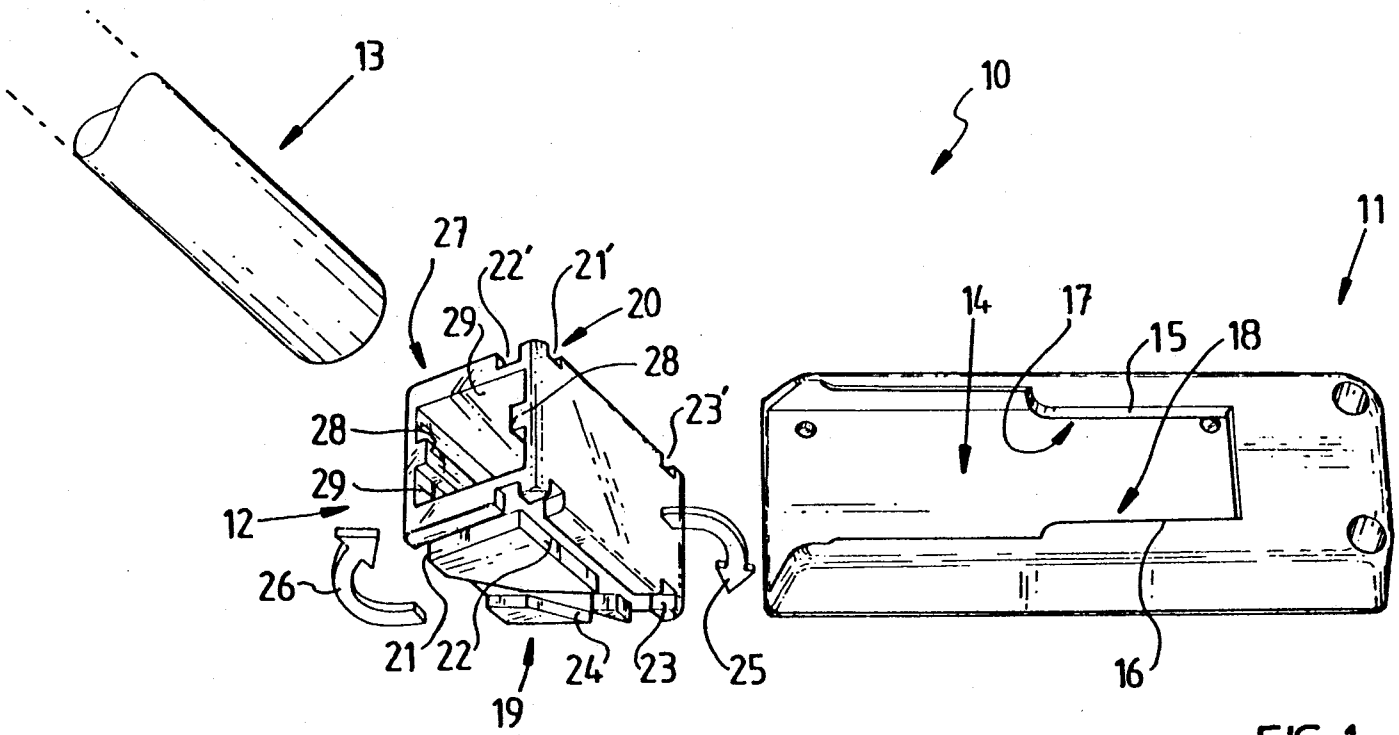
FIG. 1 is an exploded pictorial view illustrating one preferred embodiment of a connector assembly according to the present invention.

Referring to the drawings and initially to FIG. 1, there is illustrated a reconfigurable connector assembly 10 comprising a bracket 11 and a coupling block 12, the assembly 10 is suitable for a reconfigurable point-of-purchase advertising device which typically includes a flag pole 13 (part of which is illustrated in FIG. 1 but not forming part of the connector assembly). The bracket 11 includes a channel 14 having opposed projections 15 and 16 and opposed longitudinally extending recesses 17 and 18 generally underlying the projections 15 and 16 respectively. The coupling block 12 has opposed side walls 19 and 20, each side wall being provided with projection receiving slots 21, 22, 23 and 24 for side 19 and 21', 22', 23' and 24' for side 20.

As can be seen, the projection receiving slots of side wall 19 are a mirror image of the projection receiving slots of side wall 20. The coupling block 12 can be rotated according to arrows 25 and 26 so that any pair of slots can be aligned with the projections 15 and 16. The coupling block 12 is slidably insertable into the bracket 11 so that the projections can couple with the selected pair of the slots either 21, 21'; 22, 22'; 23, 23' or 24, 24' so that the block 12 can be selectively oriented with respect to the bracket 11.

In the illustrated embodiment, the coupling block 12 includes a through hole 27 so that the block is reversible and a rod or flag pole 13 or the like can be frictionally inserted into the hole 27 and retained by the projections 28 and the side walls 29 of hole 27 thus, if desired, when slots 22 and 22' are being utilised, respective flag poles can be inserted into each end of the through hole 27. This results in a further possible application and adaptation of the coupling block and connector assembly according to the present invention.

Figure 3:
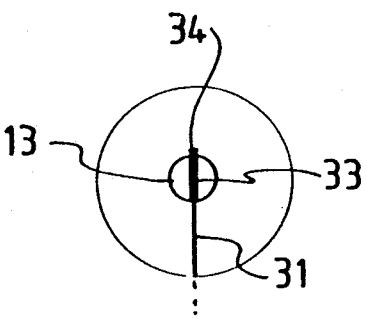
FIGS. 2 and 3 are schematic views illustrating a reconfigurable point-of-purchase advertising device according to the present invention and employing a reconfigurable connector assembly according to FIG. 1.
Figure 3:
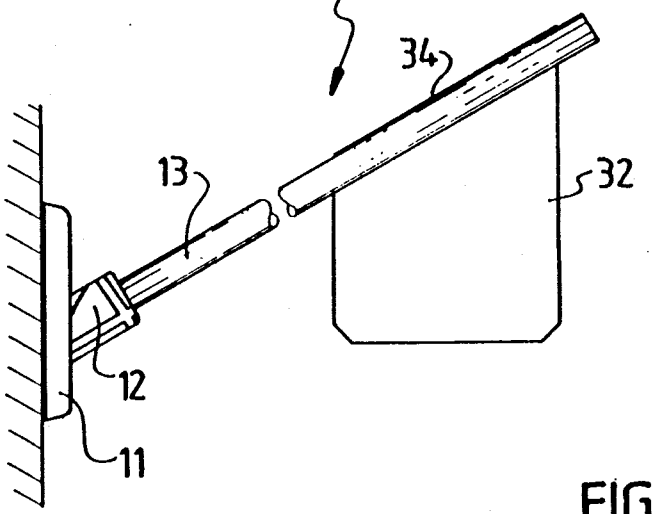
Figure 2:
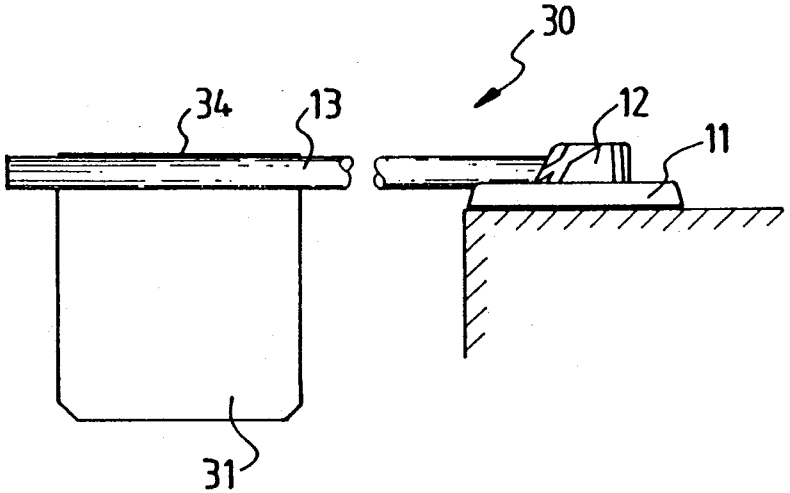

Referring now to FIGS. 2 and 3, there is illustrated application of the connector assembly of FIG. 1 to a point-of-purchase advertising device 30 employing a flag pole 13 and various shaped flags 31 and 32. Thus, in the illustrated embodiment, the point-of-purchase advertising device comprises a kit including a bracket 11, a coupling block 12, a flag pole 13 and flags 31 and 32 which can be interchanged into the various positions shown in FIGS. 1 and 2 to provide an attractive range of alternative orientations of the device to good effect. Additional flags or banners can be employed in the kit.

In each case, each flag pole 13 includes a longitudinally extending slit 33 as depicted in the inset of FIG. 3 so that a flag such as flag 31 or 32 can be threaded through the slit until the enlarged edge section 34 prevents the flag from passing through the slit and therefore enabling the flag to be retained in place as illustrated.

An alternative to having a slit extending right through the pole, where a hollow pole is employed, a single slit through the wall of the pole can be used and the resilience of the pole can be relied upon to hold the flag in place rather than using the enlarged section 34.

Thus, by reorienting the coupling block 12 and utilising each of the slots being slots 22 and 22' in FIG. 2, slots 23 and 23' in FIG. 3 as well as slots 21 and 21' and slots 24 and 24', in the present case four variations can be reconfigured using the reconfigurable point-of-purchase advertising device according to the pres invention. Of course, other slot arrangements may be in the side walls of the coupling block to give variations and although the device is depicted as a flag device, other advertising material can be suspended from flag pole 13. Likewise, it may be possible to use the connector assembly according to the present invention for purposes and therefore, it will be clear that many modifications and variations to the present invention will be apparent to those skilled in the art without departing from the broad ambit and scope of the invention as set forth in the appended claims.

I claim:

1. A reconfigurable connector assembly suitable for a reconfigurable point-of-purchase advertising device, the connector assembly including a bracket and a coupling block, the bracket having a channel, the channel having opposed projections and opposed longitudinally extending recesses generally underlying said projections, the coupling block having opposite side walls, each side wall being provided with projection receiving slots, the projection receiving slots of one side wall being a mirror image of the projection receiving slots of the other side wall, said block being slidably insertable into said bracket so that said projections can couple with a selected pair of said slots in order to selectively orient the block relative to the bracket.

2. The point-of-purchase advertising device according to claim 1 including a plurality of interchangeable flags or the like which can be suspended from the flag pole to give a particular flag orientation depending on the orientation of the flag pole.

3. The point-of-purchase advertising device of claim 2 wherein said flag pole includes flag attachment means which facilitate easy attachment and detachment of said flags, said flag attachment means comprising a longitudinally extending slit through which a flag can be threaded, and said flags having edge carrying expanded edge sections which do not readily pass through the slit.

4. The point-of-purchase advertising device of claim 1 wherein the channel includes opposed ends and is open at one end and closed at its opposite end so that the coupling block can be inserted hard up against the closed end of the channel.

5. The point-of-purchase advertising device according to claim 1 wherein the coupling block is of rectangular prism shape, the recesses being of predetermined depth and the projection receiving slots extend across the respective side walls so that the slots are open at each end making the block reversible, the side walls have peripheral edges and the slots being spaced from the edges of the respective side walls a distance corresponding to the depth of the recesses in the channel, thus affording a tight friction fit between the bracket and the coupling block when the coupling block is in place.

* * * * *